US008036559B2

(12) United States Patent
Takai et al.

(10) Patent No.: US 8,036,559 B2
(45) **Date of Patent: *Oct. 11, 2011**

(54) FIXING UNIT AND FIXING TEMPERATURE CONTROL METHOD

(75) Inventors: Masanori Takai, Shizuoka-ken (JP); Satoshi Himeno, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/977,355

(22) Filed: Dec. 23, 2010

(65) Prior Publication Data

US 2011/0091232 A1 Apr. 21, 2011

Related U.S. Application Data

(63) Continuation of application No. 12/763,332, filed on Apr. 20, 2010, now Pat. No. 7,881,631, and a continuation of application No. 11/763,508, filed on Jun. 15, 2007, now Pat. No. 7,729,629.

(30) Foreign Application Priority Data

Jun. 30, 2006 (JP) ..... 2006-182127

(51) Int. Cl.
*G03G 15/20* (2006.01)

(52) U.S. Cl. ..... 399/69

(58) Field of Classification Search ..... 399/69, 399/70, 67

See application file for complete search history.

(56) References Cited

U.S. PATENT DOCUMENTS

| | | | |
|---|---|---|---|
| 5,631,800 | A | 5/1997 | Jin et al. |
| 6,166,355 | A | 12/2000 | Watanabe et al. |
| 7,283,763 | B2 | 10/2007 | Akizuki et al. |
| 7,729,629 | B2 | 6/2010 | Takai et al. |
| 2004/0146294 | A1 * | 7/2004 | Shirokoshi |
| 2005/0141908 | A1 * | 6/2005 | Yamaguchi |
| 2005/0200915 | A1 | 9/2005 | Michiie et al. |
| 2005/0201769 | A1 | 9/2005 | Kataoka |
| 2005/0213144 | A1 | 9/2005 | Uejo |
| 2006/0093387 | A1 * | 5/2006 | Hori |
| 2007/0013933 | A1 * | 1/2007 | Miyata |
| 2007/0086037 | A1 | 4/2007 | Kitahara et al. |

FOREIGN PATENT DOCUMENTS

| | | |
|---|---|---|
| JP | 10-161466 | 6/1998 |
| JP | 2002-328562 | 11/2002 |
| JP | 2005-202219 | 7/2005 |
| JP | 2006-119194 | 5/2006 |

OTHER PUBLICATIONS

U.S. Office Action dated Oct. 1, 2009 corresponding to U.S. Appl. No. 11/763,508, filed Jun. 15, 2007.

U.S. Office Action dated Jun. 11, 2010 corresponding to U.S. Appl. No. 12/763,332, filed Apr. 20, 2010.

* cited by examiner

*Primary Examiner* — Susan Lee

(74) *Attorney, Agent, or Firm* — Turocy & Watson, LLP

(57) ABSTRACT

A fixing unit that heat-fixes the toner image onto the sheet, has an information acquisition section that acquires information concerning a factor causing the input voltage which is supplied to a heater for heating the heating roller to vary; a temperature setting section that sets a target temperature of the heater based on the information acquired by the information acquisition section; and a temperature controller that controls the temperature of the heater such that the heating roller becomes the target temperature set by the temperature setting section.

17 Claims, 7 Drawing Sheets

FIG.4

| APPARATUS STATE | Stand Alone | | | | Full Option | | | |
|---|---|---|---|---|---|---|---|---|
| ACTUAL INPUT VOLTAGE (V) | 105 | 100 | 95 | 90 | 105 | 100 | 95 | 90 |
| HEAT-SOURCE POWER (W) | 970 | | | | 840 | | | |
| HEAT-SOURCE ACTUAL OUTPUT (W) | 980 | 970 | 940 | 935 | 855 | 840 | 828 | 793 |
| CONTROL TEMPERATURE (℃) | 185 | | | | | | | |
| FIXING RATE (%) | 90 OR MORE EVEN | 90 OR MORE EVEN | 90 | 85 | 80 | 77 | 75 | 72 |
| CURLING AMOUNT (mm) | 100 | 95 | 90 | 80 | 85 | 80 | 70 | 70 |

FIG.6

| APPARATUS STATE | Stand Alone | | | | Full Option | | | |
|---|---|---|---|---|---|---|---|---|
| ACTUAL INPUT VOLTAGE (V) | 105 | 100 | 95 | 90 | 105 | 100 | 95 | 90 |
| HEAT-SOURCE POWER (W) | 970 | | | | 840 | | | |
| HEAT-SOURCE ACTUAL OUTPUT (W) | 980 | 970 | 940 | 935 | 855 | 840 | 828 | 793 |
| CONTROL TEMPERATURE (°C) | 170 | 175 | 180 | 185 | 180 | 185 | | |
| FIXING RATE (%) | 80 | 80 | 85 | 85 | 75 | 77 | 75 | 72 |
| CURLING AMOUNT (mm) | 80 | 80 | 80 | 80 | 70 | 80 | 70 | 70 |

FIXING UNIT AND FIXING TEMPERATURE CONTROL METHOD

CROSS-REFERENCE TO RELATED APPLICATIONS

This application is a Continuation of application Ser. No. 12/763,332 filed Apr. 20, 2010, which is a Continuation of application Ser. No. 11/763,508 filed Jun. 15, 2007, the entire contents of both of which are hereby incorporated by reference.

This application claims the benefit of priority from Japanese Application No. 2006-182127 filed Jun. 30, 2006, the entire contents of which is hereby incorporated by reference.

BACKGROUND OF THE INVENTION

1. Field of the Invention

The present invention relates to a temperature control technique in a fixing unit for heating and fixing a toner image onto a sheet.

2. Description of the Related Art

As a temperature control technique for a fixing unit provided in an image forming apparatus, there is known an intermittent control method. The intermittent control method performs the temperature control by turning ON and OFF a heater intermittently to achieve an image fixable temperature in a normal fixing operation. Further, this intermittent temperature control is performed in the case where a predetermined time period has elapsed since a temperature change due to influence of sheet feed operation was recognized or based on a comparison result between a measured temperature and fixing temperature (refer to, e.g., Jpn. Pat. Appln. Laid-Open Publication No. 7-114289).

The voltage of an input power source to be supplied to an image forming apparatus varies depending on the power source environment of the image forming apparatus itself or present/absence of optional apparatus attached to the image forming apparatus (e.g., about ±10%).

It is possible to employ a configuration that detects presence/absence of the optional apparatus attached to the image forming apparatus so as to set the output (W) of a heater. In this case, however, the temperature of a heating roller in a fixing unit varies in accordance with a variation in the input voltage applied to the image forming apparatus.

Typically, in the case where the voltage value of the input power source to the image forming apparatus is significantly decreased, the output of the heater becomes small to cause a disadvantage in the fixing performance. Thus, in many image forming apparatus, the fixing temperature is fixedly set so that the disadvantage in the fixing performance does not occur even at a lowest voltage value of the input power source. However, in the case where the voltage value of the input power source to be supplied to the image forming apparatus is increased, the output of the heater may become too high. Accordingly, the heat to be applied to a sheet becomes too high with the result that curling of the sheet occurs.

As described above, the fixing temperature which is a target temperature of the heating roller in the fixing unit is fixedly set in the above prior art, making it difficult to flexibly respond to a variation in the voltage value of a power source in the image forming apparatus with the result that disadvantages such as defective fixing or curling of a sheet occur.

SUMMARY OF THE INVENTION

An object of an embodiment of the present invention is to provide a technique capable of preventing disadvantages such as defective fixing and curling of a sheet irrespective of presence or absence of a variation in the voltage value of a power source in an image forming apparatus and thereby realizing satisfactory fixing processing.

To solve the above problem, according to a first aspect of the present invention, there is provided a fixing unit, comprising: a heating roller that heats a sheet to heat-fix the toner image onto the sheet; a pressure roller that presses the sheet to the heating roller; an information acquisition section that acquires information concerning a factor causing the input voltage which is supplied to a heater for heating the heating roller to vary; a temperature setting section that sets a target temperature of the heater based on the information acquired by the information acquisition section; and a temperature controller that controls the temperature of the heater such that the heating roller becomes the target temperature set by the temperature setting section.

Further, according to a second aspect of the present invention, there is provided a fixing unit, comprising: a heating roller that heats a sheet to heat-fix the toner image onto the sheet; a pressure roller that presses the sheet to the heating roller; an information acquisition means for acquiring information concerning a factor causing the input voltage which is supplied to a heater for heating the heating roller to vary; a temperature setting means for setting a target temperature of the heater based on the information acquired by the information acquisition means; and a temperature controller means for controlling the temperature of the heater such that the heating roller becomes the target temperature set by the temperature setting means.

According to a third aspect of the present invention, there is provided an image forming apparatus comprising: an image carrier that carries an electrostatic latent image corresponding to an image to be formed; a development section that visualizes the electrostatic latent image on the image carrier by means of toner; a transfer member that transfers the toner image visualized by the development section onto a sheet; an the abovementioned fixing unit that heat-fixes the toner image that has been transferred onto the sheet by the transfer section to the sheet.

According to a fourth aspect of the present invention, there is provided fixing temperature control method in a fixing unit that heat-fixes the toner image onto the sheet, the method comprising: an information acquisition that acquires information concerning a factor causing the input voltage which is supplied to a heater for heating a heating roller to vary; a temperature setting that sets a target temperature of the heater based on the information acquired in the information acquisition; and a temperature control that controls the temperature of the heater such that the heating roller becomes the target temperature set by the temperature setting.

BRIEF DESCRIPTION OF THE DRAWINGS

FIG. 4 is a table showing the fixing rate and curling amount in a conventional fixing unit;

FIG. 6 is a table showing the fixing rate and curling amount in the fixing unit according to the present embodiment.

DETAILED DESCRIPTION OF THE PREFERRED EMBODIMENTS

An embodiment of the present invention will be described below with reference to the accompanying drawings.

Figure 1:
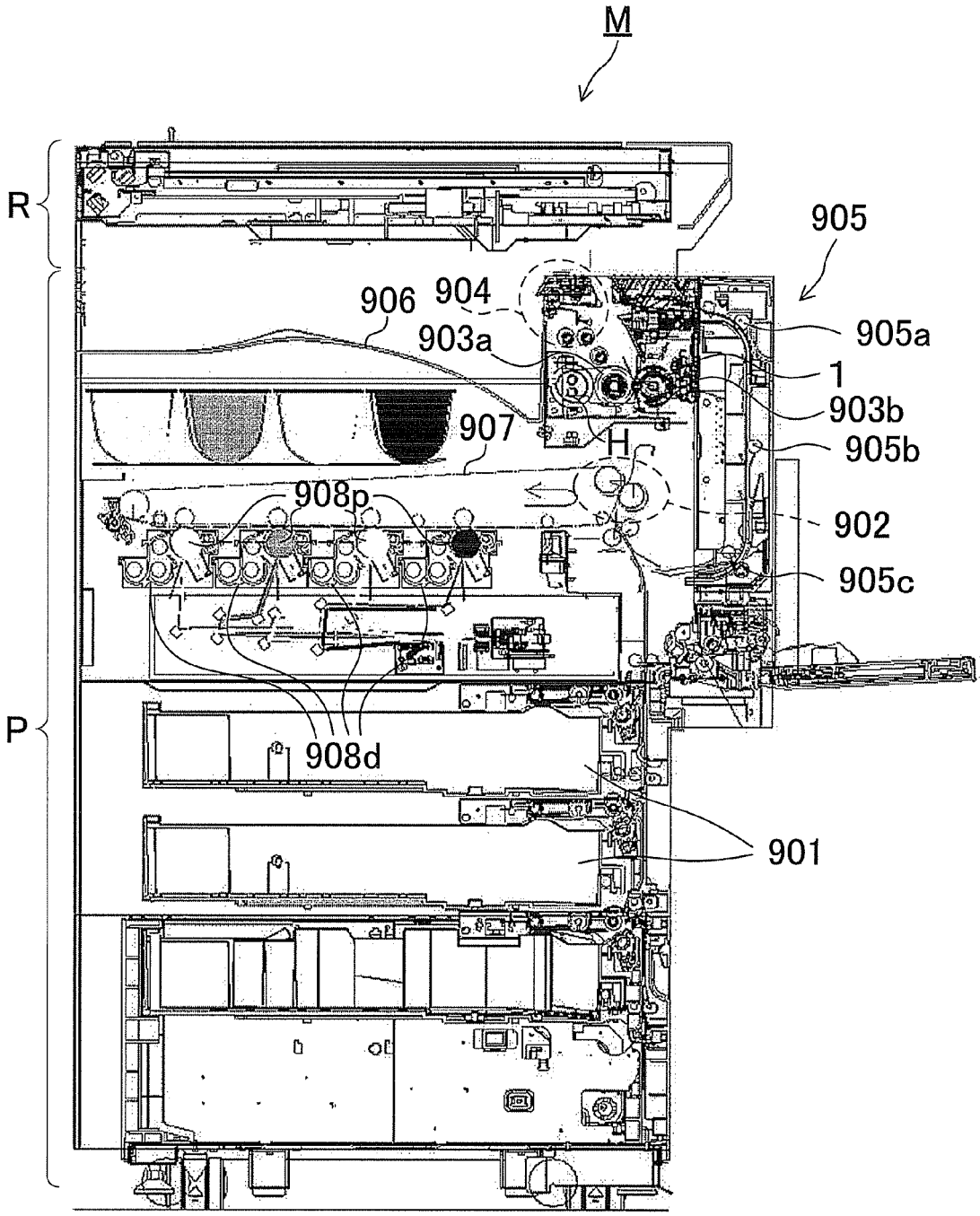
FIG. 1 is an entire configuration view for explaining the outline of an image forming apparatus M including a fixing unit 1 according to an embodiment of the present invention.

FIG. 1 is an entire configuration view for explaining the outline of an image forming apparatus M including a fixing unit 1 according to an embodiment of the present invention. As shown in FIG. 1, the image forming apparatus M according to the present invention including an image reading section R for reading an image of a document and an image forming section P for forming an image on a sheet.

The image forming section P includes a sheet supply cassette 901, a transfer section 902, a fixing unit 1, a switchback feed section 904, an ADU (Automatic Duplex Unit) 905, and a discharge tray 906. Hereinafter, the outline of a flow of double side printing of an image onto a sheet performed in the image forming apparatus M according to the present embodiment will be described.

A sheet supplied to a sheet feed path from the sheet supply cassette 901 is fed along the sheet feed path toward the transfer section 902. Meanwhile, an electrostatic latent image formed on a photoconductor drum (image carrier) 908*p* is visualized by a development section 908*d* as a toner image and transferred (primary transfer) onto an intermediate transfer belt 907.

Subsequently, the toner image that has been transferred onto the intermediate transfer belt 907 is transferred (secondary transfer) onto a first surface of the sheet in the transfer section 902 composed of the belt surface and a transfer roller (transfer member).

Subsequently, the sheet onto which the toner image has been transferred is fed to the fixing section 903 where the toner image on the first surface is heat-fixed. More specifically, the fixing unit 1 includes a heating roller 903*a* heated by a heater H and a pressure roller 903*b* and allows the pressure roller 903*b* to bring the sheet onto which the toner image has been secondary transferred into pressure contact with the heating roller 903*a* to thereby heat-fix the toner image onto the sheet.

The resultant sheet is fed to the switchback feed section 904 where the sheet is fed in a switchback manner and brought in the ADU 905. The switchback feed section 904 and ADU 905 cooperate with each other to reverse the sheet for double side printing.

The sheet brought in the ADU 905 is fed therethrough and directed to the fixing unit 902 once again. Then, a toner image is formed onto the second surface of the sheet, and the resultant sheet is fed to the fixing unit 1.

The sheet on both sides of which the images have been formed as described above is discharged to the discharge tray 906.

Optional apparatus such as an LCF (Large Capacity Feeder), an ADF (Automatic Document Feeder), an ADU (Automatic Duplex Unit), a finisher and a FAX board can additionally be attached to the image forming apparatus M according to the present embodiment. In the example of FIG. 1, the ADU 905 is attached to the image forming apparatus M. The term "optional apparatus" used here indicates an apparatus that can additionally be attached to a standard apparatus configuration in which the temperature control of the heater H for heating the heating roller in the fixing unit 1 can optimally be performed if the voltage value of the input power source to the image forming apparatus M is stable. Therefore, not all the optional apparatuses mentioned above can additionally be attached to the image forming apparatus, but any of the optional apparatuses is incorporated in the image forming apparatus as a standard specification in some cases.

In the case where the voltage value actually input to the heater H is high, heating efficiency of the heater H is increased and thereby the temperature rise curve thereof becomes sharp. Further, in the case where the less the power consumption of the optional apparatus to attached to the image forming apparatus M, power supply to the heater H is increased to enhance the heating efficiency of the heater H with the result that the temperature rise curve thereof becomes sharp. In such a case, the overshoot with respect to the target temperature (fixing temperature to be set) of the heating roller 903*a* is increased and thereby the temperature of the heating roller 903*a* remains comparatively higher than the target temperature.

An excessively high fixing temperature applies excessive heat to a sheet, which may result in occurrence of curling of the sheet. On the other hand, in the case where the voltage value actually input to the heater H is low, or where the number of optional apparatuses attached to the image forming apparatuses M is large, the power supply to the heater H is decreased to reduce the hearting efficiency of the heater H and thereby the temperature rise curve thereof becomes gentle. In such a case, while the overshoot hardly occurs, the heat of the hearting roller 903*a* continues to be absorbed by the sheets supplied in sequence even though ON-state of the heater H is maintained during sheet supply operation, which may result in defective fixing. To avoid this, it is necessary to ensure printing performance (fixing rate) by setting the fixing temperature value larger than the usual one. The fixing unit 1 according to the present embodiment is configured to be capable of suppressing adverse influence on the fixing performance due to a variation of the voltage value actually input to the heater H or additional attachment of optional apparatuses to the image forming apparatus M.

Figure 2:
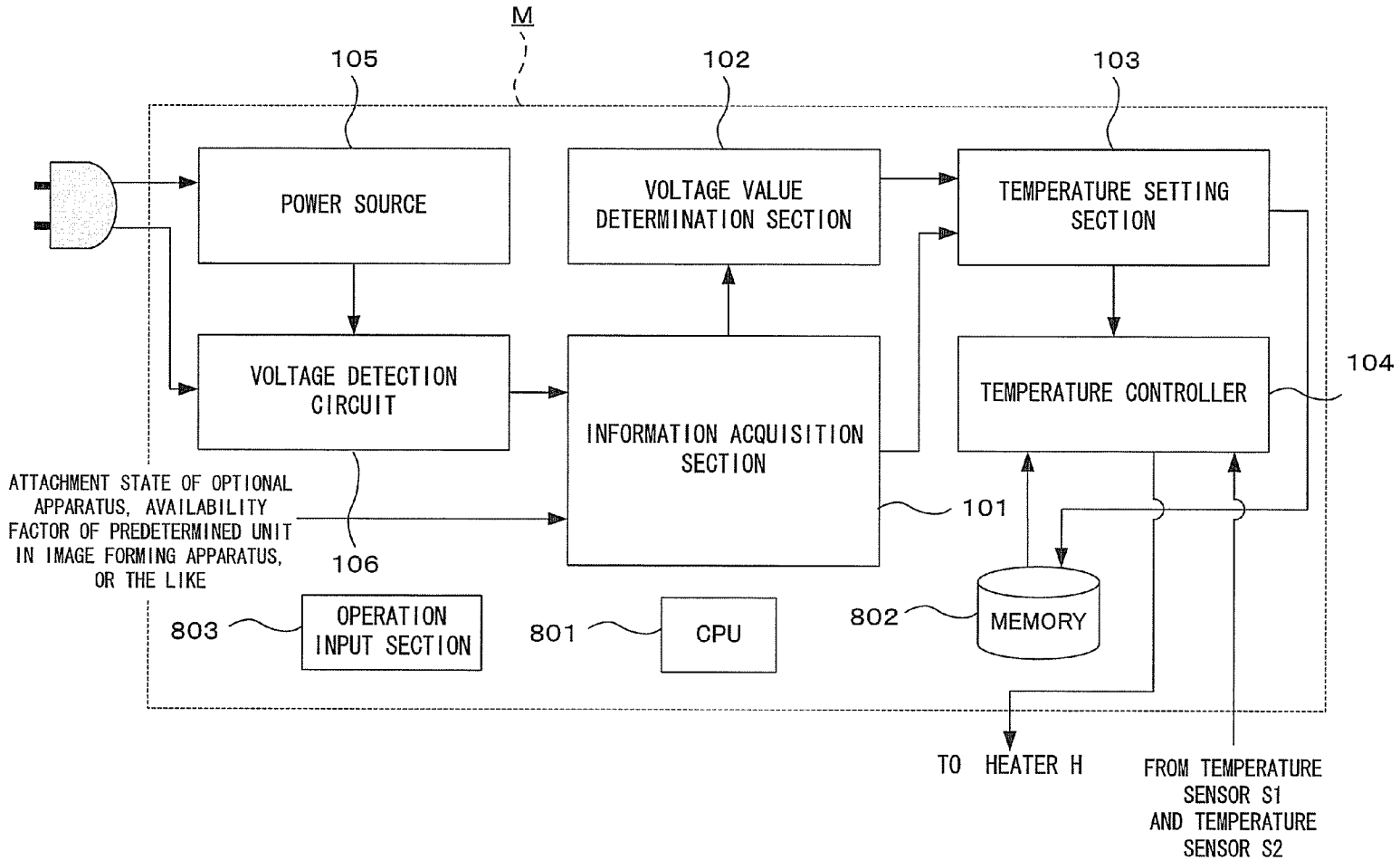
FIG. 2 is a functional block diagram for explaining the fixing unit according to the present invention and image forming apparatus M provided therewith.

FIG. 2 is a functional block diagram for explaining the fixing unit according to the present invention and image forming apparatus M provided therewith. The fixing unit 1 according to the present embodiment includes an information acquisition section (information acquisition unit) 101, a voltage value determination section (voltage value determination unit) 102, a temperature setting section (temperature setting unit) 103, a temperature controller (temperature control unit) 104, a CPU 801, a MEMORY 802, and an operation input section 803.

The information acquisition section 101 acquires information concerning a factor causing the voltage value of the input power source which is supplied to the heater H for heating the heating roller 903*a* to vary. More specifically, the information acquisition section 101 acquires information concerning the voltage value of the input power source to the image forming apparatus M or attachment state of a predetermined optional apparatus to the image forming apparatus M, such as an LCF (Large Capacity Feeder), an ADF (Automatic Document Feeder), an ADU (Automatic Duplex Unit), a finisher and a FAX board. The information acquisition section 101 further acquires information concerning the operating state of the predetermined optional apparatus that has been attached to the image forming apparatuses M. Note that the information acquisition section 101 acquires the voltage value of the input power source to the image forming apparatus M through a power source 105 and a voltage detection circuit 106.

In addition to the above, the information acquisition section 101 can acquire information concerning the operating state of a predetermined unit provided in the image forming apparatus M, such as a cooling fan, a photoconductor, and an intermediate transfer body. For example, the information acquisition section 101 acquires the availability factor of the CPU 801 in the image forming apparatus M as the information concerning the operating state of the predetermined optional apparatus or predetermined unit in the image forming apparatus M.

The voltage value determination section 102 determines the voltage value of the input voltage to the heater H based on the information acquired by the information acquisition section 101.

The temperature setting section 103 sets a target temperature of the heater based on the information acquired by the information acquisition section 101 and stores it in, e.g., the MEMORY 802. The temperature setting section 103 sets a higher target temperature as the voltage value of the input voltage to the heater H, which is determined by the voltage value determination section 102, becomes low. More specifically, the temperature setting section 103 sets a comparatively higher fixing temperature when the rated voltage of the input power source to the image forming apparatus M is low, when an optional apparatus producing a large voltage drop is attached to the image forming apparatus M, or when the availability factor of the predetermined unit provided in the image forming apparatus M is high.

On the other hand, the temperature setting section 103 sets a comparatively lower fixing temperature when the rated voltage of the input power source to the image forming apparatus M is high, when an optional apparatus producing a small voltage drop is attached to the image forming apparatus M, or when the availability factor of the predetermined unit provided in the image forming apparatus M is low. As described above, based on the information itself acquired by the information acquisition section 101 or voltage value calculated based on the information acquired by the information acquisition section 101, the temperature setting section 103 acquires a target temperature corresponding to the information from a table that has previously been stored in the MEMORY 802 so as to set the target temperature.

The temperature controller 104 acquires the target temperature set by the temperature setting section 103 from the temperature setting section 103 or MEMORY 802 and controls the temperature of the heater H such that the heating roller 903*a* becomes the target temperature.

More specifically, the temperature controller 104 ON/OFF controls the heater H such that the heating roller 903*a* becomes the target temperature corresponding to the fixing temperature based on detected temperatures in temperature sensors S1 and S2 each constituted by a thermistor for detecting the temperature of the heating roller 903*a* or pressure sensor 903*b*.

The CPU 801 performs various processing in the fixing unit 1 and image forming apparatus M, as well as, executes a programs stored in the MEMORY 802 to implement various functions. The MEMORY 802, which is constituted by an ROM or RAM, stores various information and programs used in the fixing unit 1 and image forming apparatus M.

The operation input section 803, which is constituted by a keyboard or mouse, receives an operation input from a user. The operation input section 803 may be realized by a touch-panel display having a screen display function. A user can freely control the temperature setting in accordance with the power source environment and mechanical structure of the image forming apparatus that the user uses in the case where, e.g., the curling degree of the sheet is excessive by performing operation input to the operation input section 803.

With the above configuration, by performing feedback control that makes the fixing temperature variable in accordance with the power source supplying state (voltage drop amount) in the above configuration, it is possible to optimize the amount of heat applied to a sheet in accordance with the performance variation of the heat source to thereby prevent the curling degree of the sheet from being increased.

Figure 3:
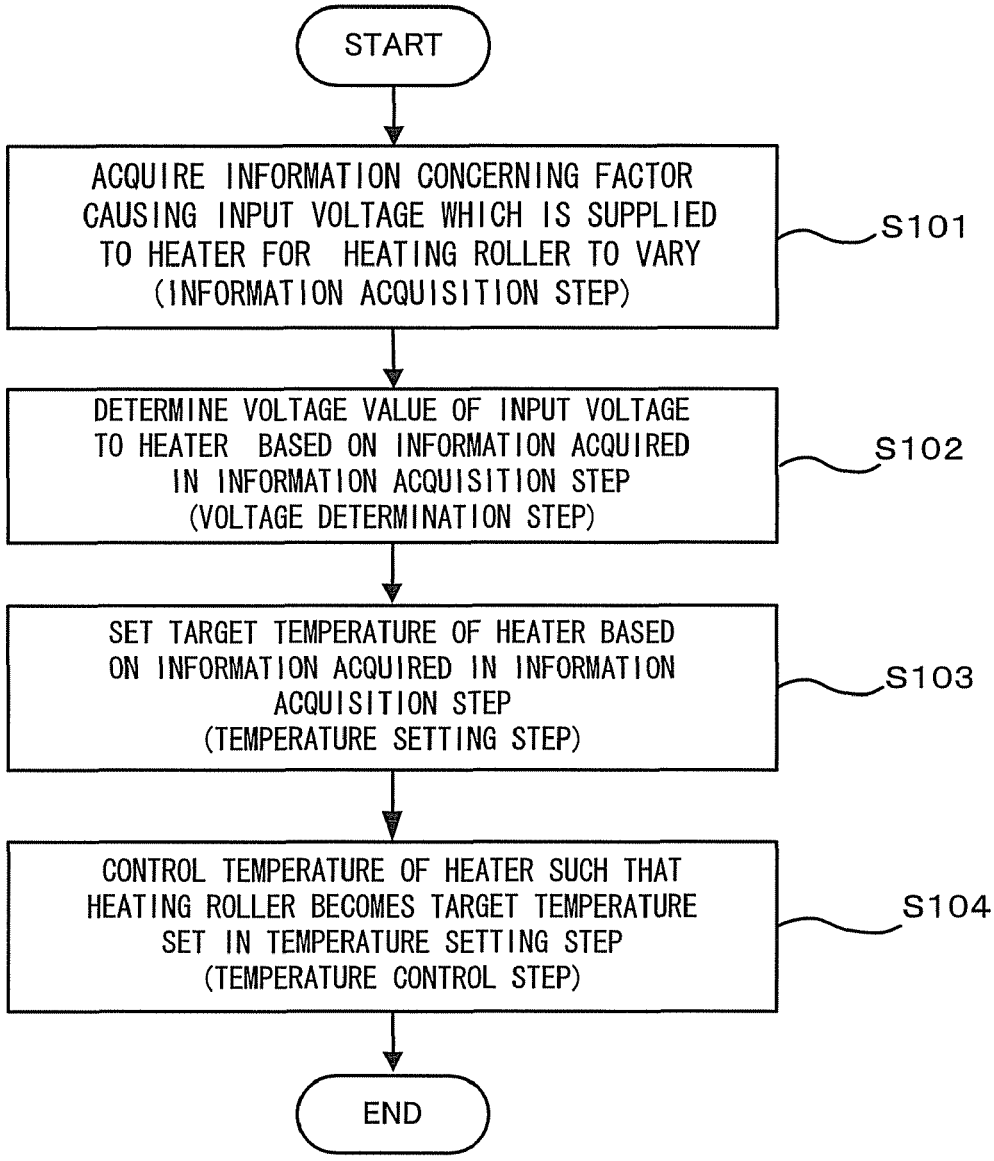
FIG. 3 is a flowchart for explaining the flow of a process (fixing temperature control method) performed in the fixing unit according to the present embodiment.

FIG. 3 is a flowchart for explaining the flow of a process (fixing temperature control method) performed in the fixing unit according to the present embodiment.

The information acquisition section 101 acquires information concerning a factor causing the input voltage which is supplied to the heater for heating the heating roller to vary (information acquisition) (S101).

Further, in the information acquisition, the information acquisition section 101 acquires information concerning the voltage value of the input power source to the image forming apparatus, attachment state of a predetermined optional apparatus (e.g., an LCF, ADF, ADU, finisher and FAX board) to the image forming apparatus and operating state thereof, and operating state of a predetermined unit (e.g., a cooling fan, photoconductor, and intermediate transfer body) provided in the image forming apparatus. In the information acquisition, the information acquisition section 101 acquires the availability factor of the CPU in the image forming apparatus as the information concerning the operating state of the predetermined optional apparatus or predetermined unit.

The voltage value determination section 102 determines the voltage value of the input voltage to the heater based on the information acquired in the information acquisition (voltage determination) (S102).

The temperature setting section 103 sets a target temperature of the heater based on the information acquired in the information acquisition (temperature setting) (S103). In the temperature setting, the temperature setting section 103 can set a higher target temperature as the voltage value of the input voltage to the heater, which is determined in the voltage value determination, becomes low and, conversely, set a lower target temperature as the voltage value of the input voltage to the heater, which is determined in the voltage value determination, becomes high.

The temperature controller 104 controls the temperature of the heater such that the heating roller becomes the target temperature set in the temperature setting (temperature control) (S104).

The above steps in the process performed in the fixing unit are implemented by the CPU 801 executing a fixing temperature control program stored in the MEMORY 802.

In the embodiment, there has been explained the case where the function for implementing the present invention is previously stored inside the apparatus, but the present invention is not limited thereto, and a similar function may be downloaded from the network into the apparatus or a recording medium on which a similar function is stored is installed in the apparatus. The recording medium may be any form of recording medium such as CD-ROM which can store programs and is readable by the apparatus. The function which can be previously obtained through installing or downloading may be realized in cooperation with the OS (operating system) inside the apparatus.

Figure 5:
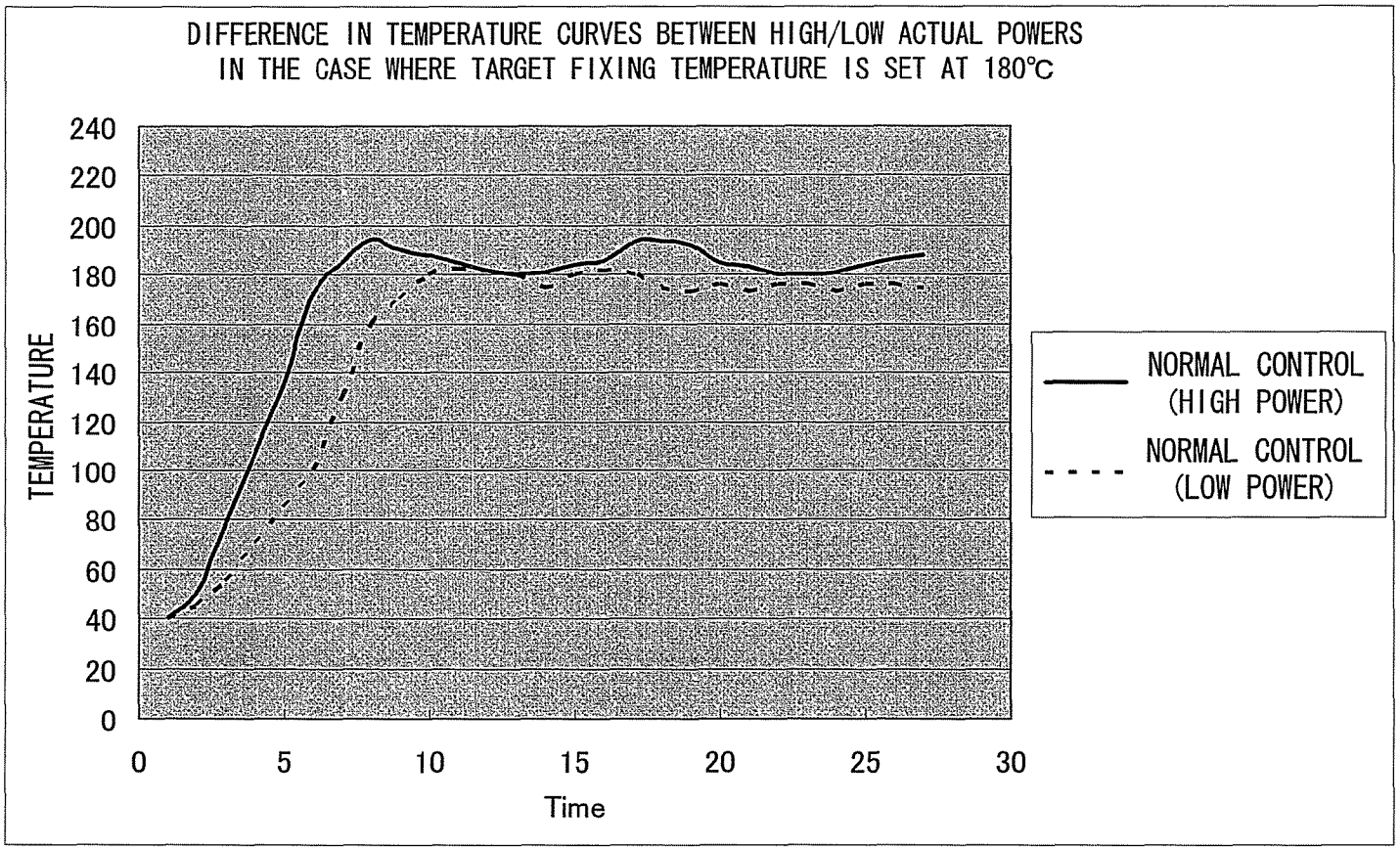
FIG. 5 is a graph showing the temperature curve in the conventional fixing unit.
Figure 7:
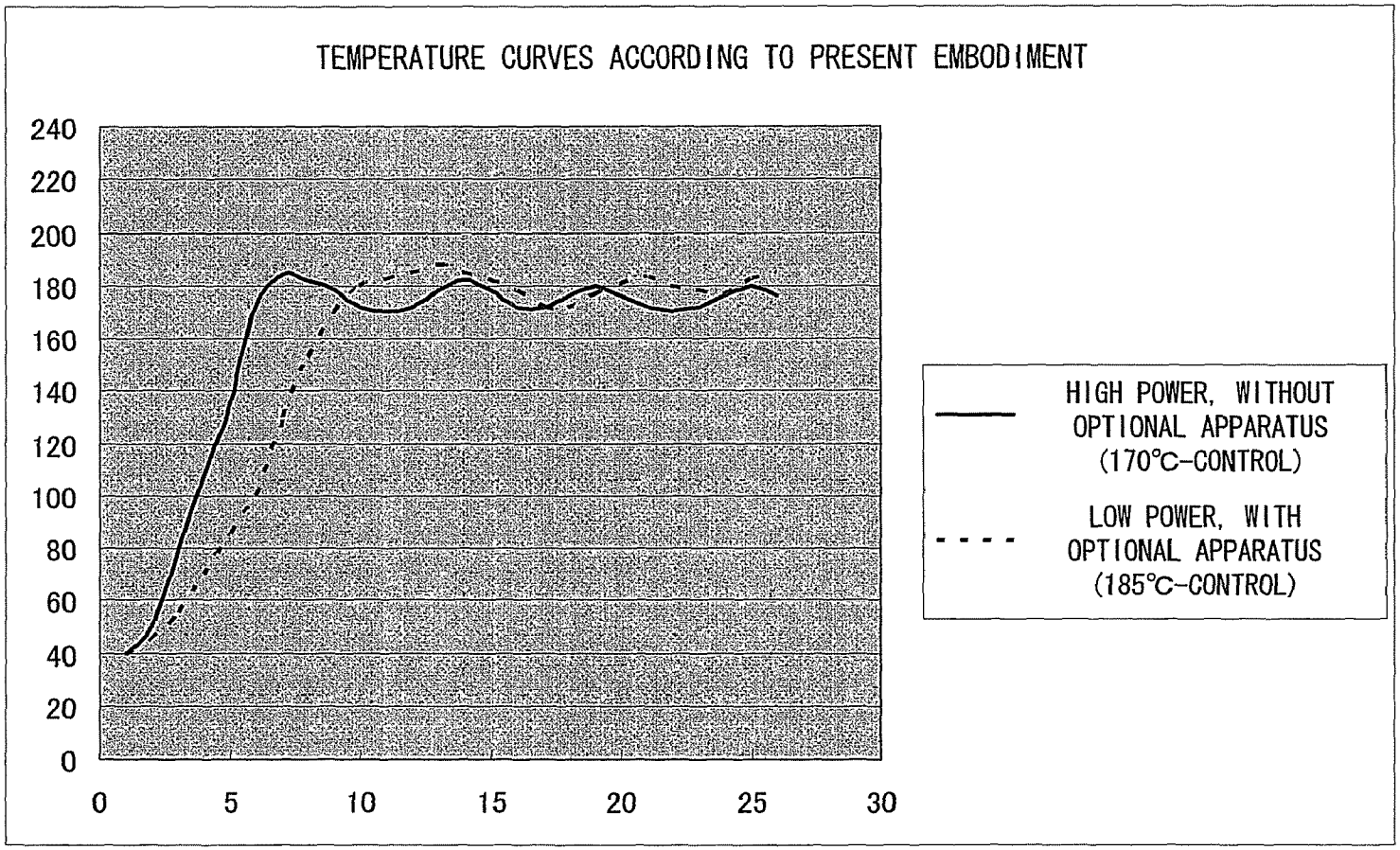
FIG. 7 is a graph showing the temperature curve in the fixing unit according to the present embodiment.

Next, the effect of the fixing temperature control technique according to the present embodiment will be described. FIG. 4 is a table showing the fixing rate and curling amount in a conventional fixing unit (fixing temperature (target temperature) is fixed to 185° C.). FIG. 5 is a graph showing the temperature curve in the conventional fixing unit. FIG. 6 is a table showing the fixing rate and curling amount in the fixing unit according to the present embodiment (fixing temperature (target temperature) is made variable in the range from 170° C. to 185° C.). FIG. 7 is a graph showing the temperature curve in the fixing unit according to the present embodiment.

FIGS. 4 and 6 each show a list of the attachment state of an optional apparatus to the image forming apparatus, actual input voltage (V) at a rated voltage of 100 V, heart-source power (W), heat-source actual output (W), heat-source control temperature (° C.), fixing rate (%), and curling amount (mm). The curl amount indicates the maximum value of stack height of 500 A4 size sheets. In FIGS. 4 and 6, "Stand Alone" indicates a normal state where no optional apparatus has been attached, and "Full Option" indicates a state where all the optional apparatus that can be attached to the image forming apparatus M have been attached thereto.

As shown in FIGS. 4 and 6, when the attachment state of the optional apparatus to the image forming apparatus or voltage value of the input power source varies, the actual output of the heat source varies. In the examples of FIGS. 4 and 6, the fixing temperature (target temperature) has been set such that the fixing rate becomes 70% or more even when the actual input power source voltage value assumes the lowest value. As shown in FIGS. 6 and 7, according to the present embodiment, by controlling (or setting) the fixing temperature in accordance with the actual voltage value of the input power source, it is possible to ensure the satisfactory fixing rate as well as prevent the curling degree from being increased.

As described above, by adequately changing the temperature setting to an optimum fixing control temperature in consideration of the input voltage to the image forming apparatus, attachment state and operating state of the optional apparatus, and the like, it is possible to respond uncertainty such as the power source condition in an install location of the image forming apparatus or mechanical structure thereof and to maintain a stable fixing temperature at all times, thereby achieving ensuring of satisfactory fixing performance and suppression of the curling degree of a sheet.

Although an exemplary embodiment of the present invention has been shown and described, it will be apparent to those having ordinary skill in the art that a number of changes, modifications, or alterations to the invention as described herein may be made within the spirit and scope of the present invention.

As has been described above, according to the present invention, it is possible to provide a technique capable of preventing disadvantages such as defective fixing and curling of a sheet irrespective of presence or absence of a variation in the voltage value of a power source in an image forming apparatus and thereby realizing satisfactory fixing processing.

What is claimed is:

1. A fixing unit, comprising:

a heating roller that heats a sheet to heat-fix a toner image onto the sheet;

a pressure roller that presses the sheet to the heating roller;

an information acquisition section that acquires information concerning a factor causing an input voltage which is supplied to a heater for heating the heating roller to vary;

a voltage value determination section that determines a voltage value of the input voltage to the heater based on the information acquired by the information acquisition section;

a temperature setting section that sets a target temperature of the heater based on the information acquired by the information acquisition section, and sets a lower target temperature as the voltage value of the input voltage to the heater, which is determined by the voltage value determination section, becomes high; and a temperature controller that controls a temperature of the heater such that the heating roller becomes the target temperature set by the temperature setting section.

2. The fixing unit according to claim 1, wherein the fixing unit is provided in an image forming apparatus for forming an image onto a sheet, and the information acquisition section acquires a voltage value of an input power source to the image forming apparatus.

3. The fixing unit according to claim 1, wherein the fixing unit is provided in an image forming apparatus for forming an image onto a sheet, and the information acquisition section acquires information concerning an attachment state of a predetermined optional apparatus to the image forming apparatus.

4. The fixing unit according to claim 1, wherein the fixing unit is provided in an image forming apparatus for forming an image onto a sheet, and the information acquisition section acquires information concerning an operating state of a predetermined optional apparatus attached to the image forming apparatus.

5. The fixing unit according to claim 3, wherein the optional apparatus includes at least any of a LCF, ADF, ADU, finisher, and FAX board.

6. The fixing unit according to claim 1, wherein the fixing unit is provided in an image forming apparatus for forming an image onto a sheet, and the information acquisition section acquires information concerning an operating state of a predetermined unit provided in the image forming apparatus.

7. The fixing unit according to claim 6, wherein the predetermined unit includes at least any of a cooling fan, photoconductor, and intermediate transfer body.

8. The fixing unit according to claim 4, wherein the information acquisition section acquires an availability factor of a CPU in the image forming apparatus as the information concerning the operating state.

9. A fixing unit, comprising:

a heating roller that heats a sheet to heat-fix a toner image onto the sheet;

a pressure roller that presses the sheet to the heating roller;

an information acquisition means for acquiring information concerning a factor causing an input voltage which is supplied to a heater for heating the heating roller to vary;

a voltage value determination means for determining a voltage value of the input voltage to the heater based on the information acquired by the information acquisition means;

a temperature setting means for setting a target temperature of the heater based on the information acquired by the information acquisition means, and sets a lower target temperature as the voltage value of the input voltage to the heater, which is determined by the voltage value determination means, becomes high; and a temperature controller means for controlling a temperature of the heater such that the heating roller becomes the target temperature set by the temperature setting means.

10. The fixing unit according to claim 9, wherein the fixing unit is provided in an image forming apparatus for forming an image onto a sheet, and the information acquisition means acquires a voltage value of an input power source to the image forming apparatus.

11. The fixing unit according to claim 9, wherein the fixing unit is provided in an image forming apparatus for forming an image onto a sheet, and the information acquisition means acquires information concerning an attachment state of a predetermined optional apparatus to the image forming apparatus.

12. The fixing unit according to claim 9, wherein the fixing unit is provided in an image forming apparatus for forming an image onto a sheet, and the information acquisition means acquires information concerning an operating state of a predetermined optional apparatus attached to the image forming apparatus.

13. The fixing unit according to claim 11, wherein the optional apparatus includes at least any of a LCF, ADF, ADU, finisher, and FAX board.

14. The fixing unit according to claim 9, wherein the fixing unit is provided in an image forming apparatus for forming an image onto a sheet, and the information acquisition means acquires information concerning an operating state of a predetermined unit provided in the image forming apparatus.

15. The fixing unit according to claim 14, wherein the predetermined unit includes at least any of a cooling fan, photoconductor, and intermediate transfer body.

16. The fixing unit according to claim 12, wherein the information acquisition means acquires the availability factor of a CPU in the image forming apparatus as the information concerning the operating state.

17. A fixing temperature control method in a fixing unit that heat-fixes a toner image onto a sheet, the method comprising:

acquiring information concerning a factor causing an input voltage which is supplied to a heater for heating a heating roller to vary;

determining a voltage value of the input voltage to the heater based on the acquired information;

setting a target temperature of the heater based on the acquired information, and setting a lower target temperature as the determined voltage value of the input voltage to the heater becomes high; and controlling a temperature of the heater such that the heating roller becomes the set target temperature.

* * * * *